US007902952B2

(12) United States Patent
Kiuchi et al.

(10) Patent No.: US 7,902,952 B2
(45) Date of Patent: Mar. 8, 2011

(54) SHARED REACTOR TRANSFORMER

(75) Inventors: Hiroshi Kiuchi, Chiyoda-ku (JP); Katsumi Konii, Chiyoda-ku (JP); Kenichi Nakamura, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 12/522,087

(22) PCT Filed: Jan. 8, 2008

(86) PCT No.: PCT/JP2008/000002

§ 371 (c)(1),
(2), (4) Date: Jul. 2, 2009

(87) PCT Pub. No.: WO2008/084757

PCT Pub. Date: Jul. 17, 2008

(65) Prior Publication Data

US 2010/0102916 A1 Apr. 29, 2010

(30) Foreign Application Priority Data

Jan. 9, 2007 (JP) ..... 2007-000960

(51) Int. Cl.
*H01F 27/24* (2006.01)
*H01F 27/28* (2006.01)

(52) U.S. Cl. ..... 336/180; 336/160; 336/220

(58) Field of Classification Search ..... 323/250, 323/254, 328, 362; 336/155, 215
See application file for complete search history.

(56) References Cited

U.S. PATENT DOCUMENTS

| | | | | |
|---|---|---|---|---|
| 4,339,792 | A * | 7/1982 | Yasumura et al. | 363/75 |
| 4,562,384 | A | 12/1985 | Owen | |
| 5,363,035 | A * | 11/1994 | Hutchison et al. | 323/254 |
| 5,416,458 | A * | 5/1995 | Menke et al. | 336/12 |
| 5,821,844 | A * | 10/1998 | Tominaga et al. | 336/110 |
| 6,046,664 | A | 4/2000 | Weller et al. | |
| 6,100,781 | A | 8/2000 | Raets et al. | |
| 6,137,391 | A * | 10/2000 | Mitamura et al. | 336/160 |
| 7,136,293 | B2 * | 11/2006 | Petkov et al. | 363/126 |

FOREIGN PATENT DOCUMENTS

| | | |
|---|---|---|
| JP | 39-011715 | 5/1964 |
| JP | 60-000719 | 1/1985 |
| JP | 61-032506 | 2/1986 |

(Continued)

OTHER PUBLICATIONS

International Search Report (PCT/ISA/210) dated Jan. 30, 2008.

(Continued)

*Primary Examiner* — Anh T Mai
(74) *Attorney, Agent, or Firm* — Buchanan Ingersoll & Rooney PC

(57) ABSTRACT

In order to additionally furnish the transformer with the reactor capability easily without having to change the structure of the transformer, a transformer is formed by winding an input-side coil 1*b* and output-side coils 1*a* and 1*c* around a shell-type iron core 2 so that voltages are induced in the output-side coils 1*a* and 1*c* by magnetic fluxes generated by a voltage applied on the input-side coil 1*b*, and two reactor coils 3*a* and 3*b* having the same winding number in the opposite winding directions and making a pair are wound around the shell-type iron core 2. A shared reactor transformer as a whole is thus formed.

3 Claims, 4 Drawing Sheets

FOREIGN PATENT DOCUMENTS

| | | | |
|---|---|---|---|
| JP | 64-010736 | U | 1/1989 |
| JP | 64-064309 | | 3/1989 |
| JP | 01-155607 | | 6/1989 |
| JP | 6-82582 | B2 | 10/1994 |
| JP | 11-243019 | | 9/1999 |

OTHER PUBLICATIONS

International Search Report in corresponding International Application No. PCT/JP2008/000002 dated Feb. 12, 2008.

* cited by examiner

【FIG.1】
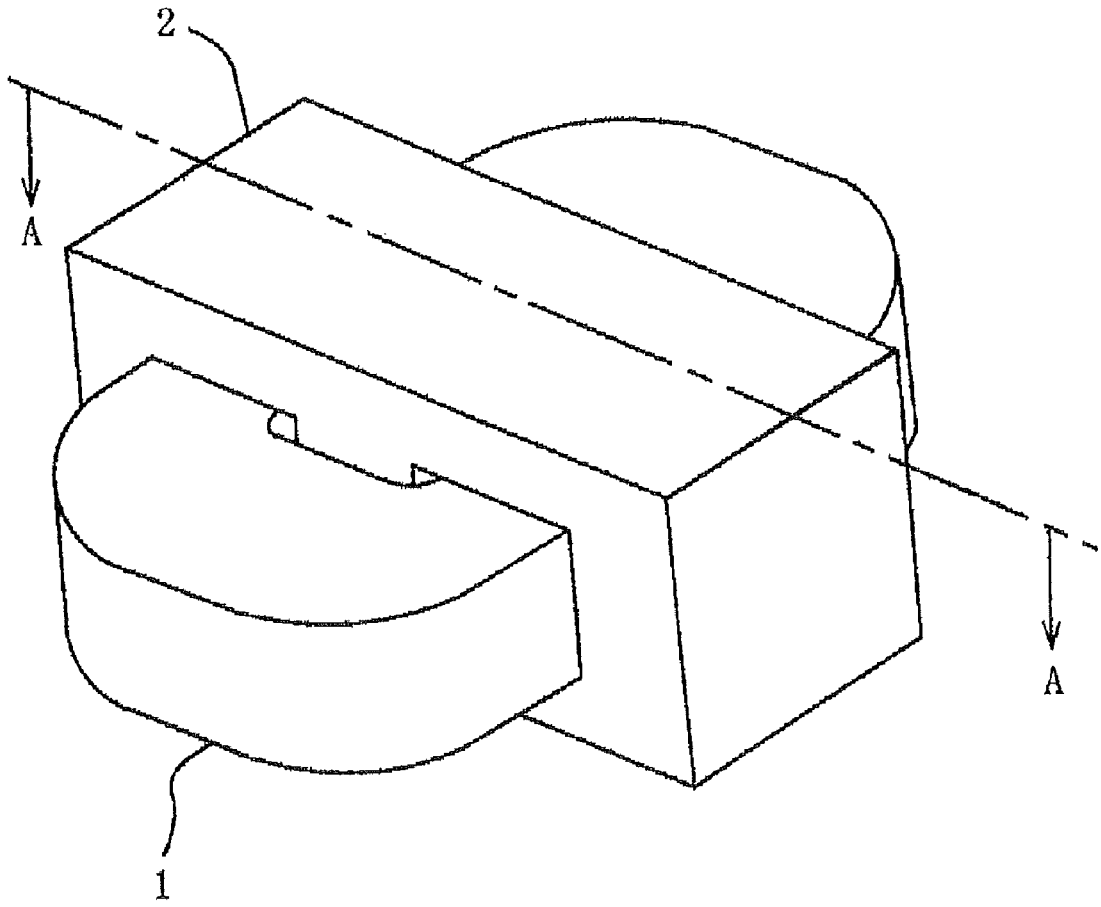

【FIG. 2】
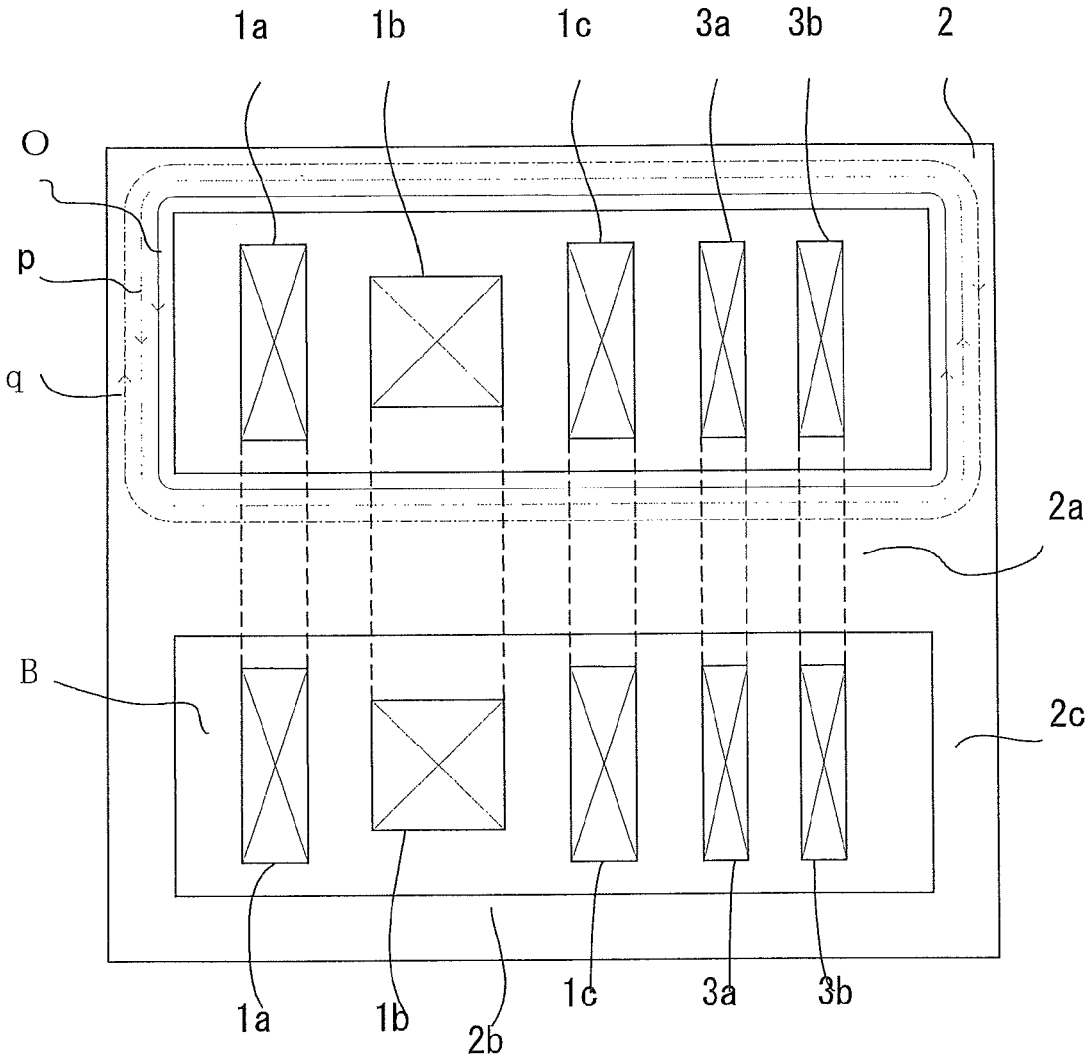

【FIG. 3】
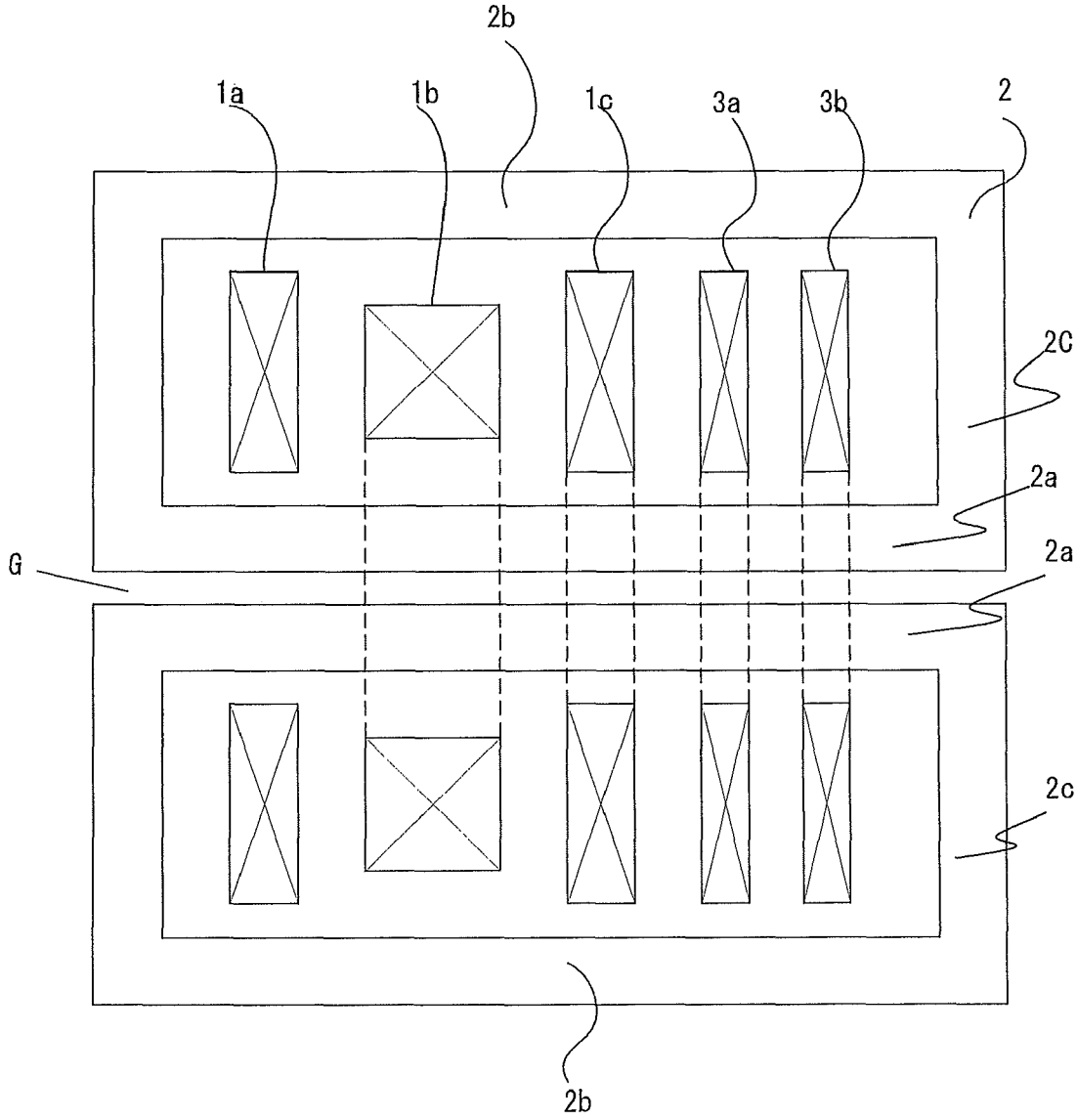

【FIG.4】
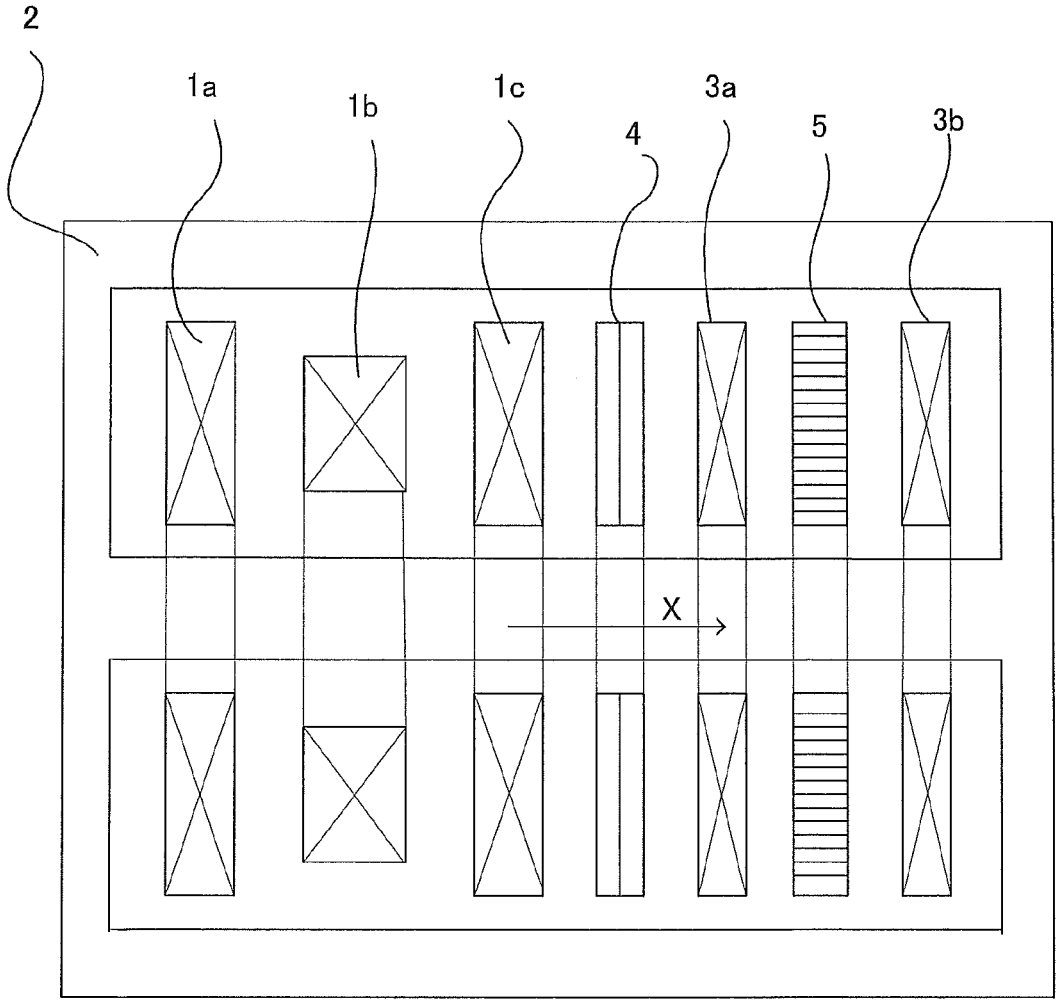

SHARED REACTOR TRANSFORMER

TECHNICAL FIELD

The present invention relates to a shared reactor transformer achieved by additionally furnishing, for example, a vehicle transformer mounted beneath the floor of a vehicle with a reactor capability.

BACKGROUND ART

In a case where the reactor capability is additionally furnished to the transformer in the related art, it is general to share a part of the iron core or to incorporate a separately fabricated reactor into the transformer. Also, there is a configuration in which a transformer and a separately fabricated reactor are formed integrally with a tank.

Further, there is a shared shunt reactor transformer in the related art formed of a bypass iron core provided in apart of the yoke of the transformer and a gap iron core and a reactor coil provided in a space surrounded by a part of the yoke and the bypass iron core. The bypass iron core forms the yoke of the reactor and the winding directions of the coil in the transformer and the coil in the shunt reactor are set so that the transformer magnetic flux in a part of the yoke and the reactor magnetic flux are cancelled out each other (see Patent Document 1).

Patent Document 1: JP-B-06-82582

DISCLOSURE OF THE INVENTION

Problems to be Solved by the Invention

Because the shared reactor transformer in the related art is configured as above, the reactor inevitably becomes a separate structure from the transformer. This possesses problems that the number of components is increased and the shape of the tank becomes complex.

The invention has been made to solve the problems as above and has an object to provide a shared reactor transformer achieved by additionally furnishing the transformer with the reactor capability without having to change the structure of the transformer.

Means for Solving the Problems

A shared reactor transformer of the invention includes an iron core, an input-side coil and output-side coils that are coils in a transformer wound around the iron core, and reactor coils wound around the iron core, two of which or two groups of which having a same winding number make a pair. The reactor coils are connected to each other so that magnetic fluxes induced by the reactor coils are cancelled out each other.

Advantage of the Invention

According to the shared reactor transformer of the invention, it includes an iron core, an input-side coil and output-side coils that are coils in a transformer wound around the iron core, and reactor coils wound around the iron core, two of which or two groups of which having a same winding number make a pair. The reactor coils are connected to each other so that magnetic fluxes induced by the reactor coils are cancelled out each other. It thus becomes possible to additionally furnish the transformer with the reactor capability easily without having to change the configuration of the transformer itself.

In addition, the need to change the iron core structure itself in the transformer is eliminated, and further, the need for a bypass iron core necessary in the related art is eliminated. It thus becomes possible to reduce the overall device both in size and weight. Further, because there is no need for a work to incorporate the transformer and the reactor as a separate structure into a tank as in the related art, it becomes possible to reduce the cost incurred from an assembly work.

BRIEF DESCRIPTION OF THE DRAWINGS

FIG. 1 is a perspective view showing a typical example of a shell-type transformer.

FIG. 2 is a cross section showing a shared reactor transformer according to a first embodiment of the invention.

FIG. 3 is a cross section showing a shared reactor transformer according to another example.

FIG. 4 is a cross section showing a shared reactor transformer according to a second embodiment of the invention.

BEST MODE FOR CARRYING OUT THE INVENTION

First Embodiment

FIG. 1 is a perspective view of a typical so-called shell-type transformer. Referring to FIG. 1, a coil 1 in the transformer is wound around an iron core 2 and the iron core 2 is provided to be positioned on the outside of the coil 1.

FIG. 2 is a cross section showing a shared reactor transformer according to a first embodiment of the invention. FIG. 2 is a cross section corresponding to a cross section taken on line A-A of FIG. 1. Although FIG. 1 shows only one coil 1, a plurality of coils 1*a*, 1*b*, 1*c*, 3*a*, and 3*b* are wound around the iron core 2 in practice as is shown in FIG. 2.

Referring to FIG. 2, the coils 1*a*, 1*b*, and 1*c* are coils forming the transformer. The input-side coil 1*b* and the output-side coils 1*a* and 1*c* are wound around the iron core 2. The output-side coils 1*a* and 1*c* generate a voltage with a magnetic flux induced by a voltage applied on the input-side coil 1*b*. The coils 3*a* and 3*b* are coils forming the reactor.

The iron core 2 includes a main iron core 2*a*, legs 2*b* disposed in parallel on the both sides of the main iron core 2*a*, and yokes 2*c* that couple these main iron core 2*a* and legs 2*b*. The input-side coil 1*b* is wound around the main iron core 2*a* inside a space B surrounded by the iron core 2.

The two output-side coils 1*a* and 1*c* are also wound around the main iron core 2*a* inside the space B surrounded by the iron core 2. The output-side coils 1*a* and 1*c* are disposed so as to sandwich the input-side coil 1*b* on the both sides thereof in the axial direction.

The reactor coils 3*a* and 3*b* are coils of the same shape except that the winding directions are opposite to each other. The shared reactor transformer is formed by winding the coils 3*a* and 3*b*, which are two coils having opposite winding directions and making a pair, around the same iron core 2 in the transformer.

For the reactor coils 3*a* and 3*b*, coils of the same shape as the output-side coils 1*a* and 1*c* and the input-side coil 1*b* in the transformer and having a different winding number are used.

An operation of the shared reactor transformer configured as above will now be described. The shared reactor transformer is mounted beneath the floor of a vehicle. Power is obtained at the pantograph from a trolley wire and fed to the input-side coil 1*b* wound around the iron core 2 in the on-board transformer via a breaker.

A voltage received from the trolley wire via the pantograph and the breaker is inputted into the input-side coil 1*b* in the on-board transformer. The voltage is then transformed and outputted to the output-side coils 1*a* and 1*c* in the on-board transformer.

Outputs of the output-side coils 1*a* and 1*c* are supplied to a PWM converter in which a single-phase alternating current is converted to a direct current. The converted direct current is further fed to an inverter in which the direct current is converted to a three-phase alternating current. The three-phase alternating current drives a three-phase electric motor for driving the wheels of the vehicle. Herein, the reactor coils 3*a* and 3*b*, by being disposed between the PWM converter and the inverter, are allowed to function as a smoothing reactor.

By flowing a current into the respective coils 1*a*, 1*b*, 1*c*, 3*a*, and 3*b* forming the shared reactor transformer, the iron core 2 generates a magnetic flux O induced by the transformer coils 1*a*, 1*b*, and 1*c* and indicated by a solid line, a magnetic flux p induced by the reactor coil 3*a* and indicated by a dotted line, and a magnetic flux q induced by the reactor coil 3*b* and indicated by an alternate long and short dashed line.

Herein, the reactor coils 3*a* and 3*b* are coils of the same shape and having the same winding number in the opposite winding directions. The magnetic fluxes p and q are therefore magnetic fluxes of the same magnitude in the opposite directions.

Hence, because the magnetic fluxes p and q are cancelled out each other, the magnetic flux O alone remains in the iron core 2. Accordingly, the iron core 2 of a size large enough to pass through the magnetic flux O alone is sufficient. In comparison with a device in the related art in which the transformer and the reactor are formed separately, it becomes possible to reduce the overall device in size.

As has been described, because the reactor coils 3*a* and 3*b* are formed in the same shape as the transformer coils 1*a*, 1*b*, and 1*c*, it becomes possible to additionally furnish the transformer with the reactor capability easily without having to change the configuration of the transformer itself.

In addition, the need to change the iron core structure itself in the transformer is eliminated, and further, the need for the bypass iron core necessary in the related art is eliminated. It thus becomes possible to reduce the overall device both in size and weight. Also, because there is no need for a work to incorporate the transformer and the reactor as a separate structure into the tank as in the related art, it becomes possible to reduce the cost incurred from an assembly work.

By further providing additional reactor coils in parallel with the coils 3*a* and 3*b* in FIG. 2, the reactor value can be readily increased. In this case, because two coils making a pair are added in parallel, the coils are increased by an even number, such as, four, six, eight, and so on.

In a case where four reactor coils are provided, two coils form one group. That is to say, a total of four reactor coils are provided by making two groups into a pair. Likewise, by forming one group from three or four coils or more and making two groups into a pair, a total of six or eight coils or more are provided.

Hence, when the structure shown in FIG. 2 is included, the shared reactor transformer is formed by winding reactor coils, two of which or two groups of which having the same winding number in the opposite winding directions form a pair, around the same iron core. A case where no gap is provided to the main iron core 2*a* has been described with reference to FIG. 2. However, as is shown in FIG. 3, it is possible to provide a gap G.

When configured in this manner, because the iron core is completely divided into halves, the flow of a magnetic flux is completely divided into upper and lower halves in comparison with the structure of FIG. 2. The flow of the magnetic flux therefore becomes simpler without being shunt in the middle and an amount of core loss can be lessened. Also, by adopting the structure shown in FIG. 3, the width of the iron core becomes all the same in the main iron core 2*a*, the legs 2*b*, and the yokes 2*c*. It is therefore sufficient to cut an iron core in the same width.

Second Embodiment

FIG. 4 is a cross section showing a shared reactor transformer according to a second embodiment of the invention. Referring to the drawing, a separate iron core 4 is provided between the coils 1*a*, 1*b*, and 1*c* in the transformer and the coils 3*a* and 3*b* in the reactor, so that the coils 1*a*, 1*b*, and 1*c* in the transformer are unsusceptible to the coils 3*a* and 3*b* in the reactor. To be more specific, as is shown in FIG. 4, the separator iron core 4 is formed by piling up a plurality of iron cores in the axial direction X so that a magnetic flux leaking from the coil 3*a* in the reactor will not pass through the coil 1*c* in the transformer.

By providing the separator iron core 4 in this manner, not only it is possible to prevent a leaking magnetic flux in the reactor from giving influences on the transformer, but it is also possible to prevent a leaking magnetic flux in the transformer from giving influences on the reactor.

Further, as is shown in FIG. 4, a gap iron core 5 to change reactance of the reactor coils 3*a* and 3*b* may be provided between the reactor coils 3*a* and 3*b*. The gap iron core 5 is formed by piling up a plurality of strips of iron cores in the same shape in a direction perpendicular to the axial direction X, so that a leaking magnetic flux can be stored between the reactor coils 3*a* and 3*b*.

The reactance can be changed by inserting the gap iron core 5 in this manner. More specifically, because the leaking magnetic flux concentrates in the gap iron core 5, the reactance can be increased. It thus becomes possible to change the reactance of the reactor coils 3*a* and 3*b* by changing the shape and the size of the gap iron core 5.

The above has described a case where the gap iron core 5 is provided between the two reactor coils 3*a* and 3*b* with reference to the configuration shown in the drawing. In a case where the reactor coils are formed of two groups having four or more coils, the gap iron core is provided between the two groups of the reactor coils. Also, the first and second embodiments have described the shell-type transformer. However, the configurations described above can be adopted in a core-type transformer as well. The embodiments above have described cases where the invention is used for a vehicle. The invention, however, can be also used in another application.

INDUSTRIAL APPLICABILITY

The invention is applicable not only to a vehicle transformer but also generally to a shared reactor transformer additionally furnished with the reactor capability.

The invention claimed is:

1. A shared reactor transformer comprising:

an iron core;

an input-side coil and output-side coils that are coils in a transformer wound around the iron core; and reactor coils wound around the iron core, two of which or two groups of which having a same winding number make a pair, wherein the reactor coils making the pair are connected to each other so that magnetic fluxes induced by the reactor coils are cancelled out by each other.

2. The shared reactor transformer according to claim 1, wherein:

a separator iron core is provided between the coils in the transformer and the reactor coils, so that the coils in the transformer are unsusceptible to a leaking magnetic flux from the reactor coils.

3. The shared reactor transformer according to claim 1, wherein:

a gap iron core is provided between the two or the two groups of the reactor coils in order to change reactance of the reactor coils.

* * * * *